US009612049B2

(12) United States Patent
Wu et al.

(10) Patent No.: US 9,612,049 B2
(45) Date of Patent: Apr. 4, 2017

(54) SENSOR MOUNT FOR A MOBILE REFRIGERATION SYSTEM

(75) Inventors: Zhigang Wu, Suzhou (CN); Degang Fu, Shanghai (CN); Yun Li, Shanghai (CN); Stevo Mijanovic, South Windsor, CT (US); Mark J. Perkovich, Fayetteville, NY (US); Thomas D. Radcliff, Vernon, CT (US)

(73) Assignee: Carrier Corporation, Jupiter, FL (US)

( * ) Notice: Subject to any disclaimer, the term of this patent is extended or adjusted under 35 U.S.C. 154(b) by 471 days.

(21) Appl. No.: 13/518,310

(22) PCT Filed: Dec. 21, 2010

(86) PCT No.: PCT/US2010/061571
§ 371 (c)(1),
(2), (4) Date: Nov. 19, 2012

(87) PCT Pub. No.: WO2011/084800
PCT Pub. Date: Jul. 14, 2011

(65) Prior Publication Data

US 2013/0055734 A1 Mar. 7, 2013

Related U.S. Application Data

(60) Provisional application No. 61/288,658, filed on Dec. 21, 2009.

(51) Int. Cl.
*F25D 21/06* (2006.01)
*F25D 29/00* (2006.01)

(52) U.S. Cl.
CPC ..... *F25D 29/005* (2013.01); *F25B 2500/13* (2013.01); *F25B 2700/21172* (2013.01)

(58) Field of Classification Search
CPC ..... F25B 2700/11; F25D 2700/10; F25D 2700/121; F25D 2700/122; F25D 2700/123; F25D 2700/14; F24D 2240/00; F24D 2240/24; F24D 2240/243
USPC ..... 62/408, 265, 295; 374/132, 138, 208
See application file for complete search history.

(56) References Cited

U.S. PATENT DOCUMENTS

| | | | | |
|---|---|---|---|---|
| 2,866,058 | A | 12/1958 | Hebenstreit | |
| 4,525,081 | A * | 6/1985 | Myhre | 374/208 |
| 5,369,957 | A | 12/1994 | Hanson | |
| 5,557,938 | A | 9/1996 | Hanson et al. | |
| 5,730,216 | A | 3/1998 | Viegas et al. | |

(Continued)

FOREIGN PATENT DOCUMENTS

| | | | |
|---|---|---|---|
| DE | 3620246 A1 * | 12/1987 | |
| JP | 9 193650 | 7/1997 | |

(Continued)

*Primary Examiner* — Ryan J Walters
*Assistant Examiner* — Erik Mendoza-Wilkenfe
(74) *Attorney, Agent, or Firm* — O'Shea Getz P.C.

(57) ABSTRACT

A refrigeration system for a mobile unit includes a refrigeration loop (32), an air duct (70), a sensor (34) and a shock absorption unit (36). The refrigeration loop includes a compressor, a condenser, a refrigerant regulator and an evaporator (64). The air duct directs air from an air inlet to the evaporator, which air duct is defined by first and second panels. The sensor is disposed in the air duct. The shock absorption unit mounts the sensor to and provides a limited thermal conduction path between the sensor and the first panel (22).

23 Claims, 3 Drawing Sheets

(56) References Cited

U.S. PATENT DOCUMENTS

| | | | | |
|---|---|---|---|---|
| 6,044,651 | A | 4/2000 | Reason et al. | |
| 6,141,981 | A | 11/2000 | Reason et al. | |
| 6,196,012 | B1 | 3/2001 | Reason et al. | |
| 6,318,100 | B1 | 11/2001 | Brendel et al. | |
| 6,461,309 | B1 * | 10/2002 | Smith | 600/551 |
| 6,609,388 | B1 * | 8/2003 | Hanson | 62/151 |
| 6,698,212 | B2 | 3/2004 | Viegas et al. | |
| 6,964,172 | B2 | 11/2005 | Dudley et al. | |
| 7,080,521 | B2 | 7/2006 | Ludwig et al. | |
| 2006/0064024 | A1 * | 3/2006 | Schnall | A61B 5/02007 600/500 |
| 2008/0083238 | A1 | 4/2008 | Sandkoetter | |
| 2009/0113914 | A1 * | 5/2009 | Kitano et al. | 62/239 |
| 2009/0212598 | A1 * | 8/2009 | Otterstrom | 296/181.5 |
| 2010/0107737 | A1 * | 5/2010 | Krafthefer et al. | 73/28.01 |
| 2010/0253089 | A1 * | 10/2010 | Huang et al. | 290/1 R |

FOREIGN PATENT DOCUMENTS

| | | | |
|---|---|---|---|
| JP | 10-160336 | * | 6/1998 |
| JP | 10 160336 | | 6/1998 |
| JP | 10160336 | * | 6/1998 |
| JP | 2001 208468 | | 8/2001 |

* cited by examiner

SENSOR MOUNT FOR A MOBILE REFRIGERATION SYSTEM

This patent applications claims priority to PCT Patent Application no. PCT/US10/61571 filed Dec. 21, 2010, which claims priority to U.S. Provisional Patent Application No. 61/288,658 filed Dec. 21, 2009, the disclosure of which is herein incorporated by reference.

BACKGROUND OF THE INVENTION

1. Technical Field

This disclosure relates generally to mobile heat exchange systems and, more particularly, to sensor mounts for mobile refrigeration systems.

2. Background Information

Heat exchange systems are used to regulate internal environmental conditions in mobile units such as vehicles, trailers or shipping containers. For example, air temperature within a trailer transporting perishable goods (e.g., food, medication, etc.) is regulated to prevent spoilage and to maximize shelf life of the goods. Typically, such a heat exchange system includes a generator, a refrigeration unit having an evaporator, a return air duct, a supply air duct, a return air temperature ("RAT") sensor and a controller. The evaporator is disposed between the return air duct and the supply air duct. The RAT sensor is mounted in the return air duct proximate the evaporator.

In operation, the RAT sensor measures the air temperature within the return air duct to estimate the air temperature within the trailer. The RAT sensor provides an output signal indicative of the measured air temperature to the controller. The controller compares the sensor output signal to a predetermined set point. When the sensor output signal indicates that the air temperature within the return air duct is greater than the predetermined value, the controller (in an on-cycle) turns the refrigeration unit on to cool the internal environment in the trailer. When the output signal indicates that the air temperature within the return air duct is less than the predetermined value, the controller (in an off-cycle) turns the refrigeration unit off to conserve energy and prevent over-cooling of the goods.

In theory, the refrigeration system is only turned on when air temperature within the trailer (estimated by the air temperature in the return air duct) is greater than or equal to the predetermined value. In practice, however, the air temperature in the return air duct does not always accurately estimate the air temperature within the trailer. For example, during the on-cycle, the generator provides power to the refrigeration unit. As a byproduct of providing power, the generator radiates and/or conducts thermal energy into the surrounding environment. Depending upon the configuration of the heat exchange unit, some of that thermal energy can increase the temperature of the air within the return air duct proximate the RAT sensor. In such a case, the signal from the RAT sensor would not accurately reflect the temperature conditions within the trailer. This temperature differential can lead to the refrigeration system remaining in the on-cycle for extended periods of time, even after the air temperature within the trailer has fallen below the predetermined temperature value. In another example, during the off-cycle, a heat buildup in the generator from sustained use may be radiated and/or conducted into the surrounding environment. This thermal energy can create a similar temperature differential such that the on-cycle is prematurely engaged; e.g., the air temperature proximate the RAT sensor increases above the predetermined value, while the air temperature within the trailer remains below the predetermined value. Disadvantageously, the temperature differential can (i) increase the number of on/off cycles per period, and (ii) increase the length of time the refrigeration unit is turned on, thereby increasing the cost of operating the heat exchange system.

SUMMARY OF THE DISCLOSURE

According to one aspect of the invention, a refrigeration system for a mobile unit includes a refrigeration loop, an air duct, a sensor and a shock absorption unit. The refrigeration loop includes a compressor, a condenser, a refrigerant regulator and an evaporator. The air duct directs air from an air inlet to the evaporator, which air duct is defined by first and second panels. The sensor is disposed in the air duct. The shock absorption unit mounts the sensor to and provides a limited thermal conduction path between the sensor and the first panel.

According to another aspect of the invention, a method is provided for regulating environmental conditions in a control region of a mobile unit. The method includes the steps of: 1) providing a mobile refrigeration system including a power package and a sensor disposed in a return air duct; 2) substantially thermally isolating the sensor from thermal energy radiated and conducted from the power package; 3) measuring with the sensor at least one parameter indicative of the environmental conditions in the control region of the mobile unit; and 4) regulating the environmental conditions in the mobile unit based on the measured parameter.

According to still another aspect of the invention, a method is provided for regulating environmental conditions in a control region of a mobile unit. The method includes the steps of: 1) providing a mobile refrigeration system including a first duct extending between an air inlet and an evaporator, a second duct extending between the evaporator and an air outlet, and a sensor; 2) dampening a dynamic shock load transferred to the sensor; 3) measuring with the sensor at least one parameter indicative of the environmental conditions in the control region of the mobile unit; and 4) regulating the environmental conditions in the mobile unit based on the measured parameter.

DETAILED DESCRIPTION OF THE INVENTION

Figure 1:
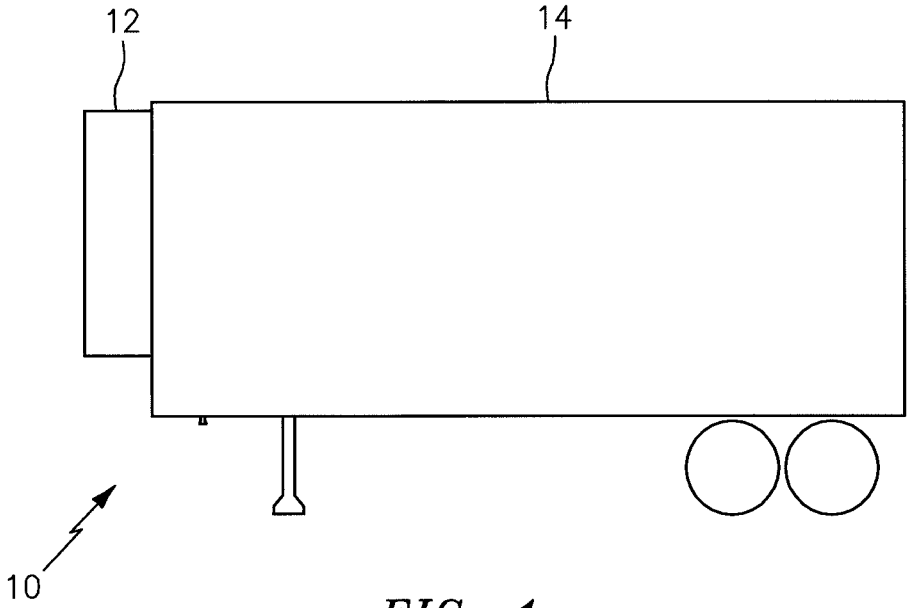
FIG. 1 is a diagrammatic illustration of one embodiment of a refrigerated transportation unit having a mobile refrigeration system.
Figure 2:
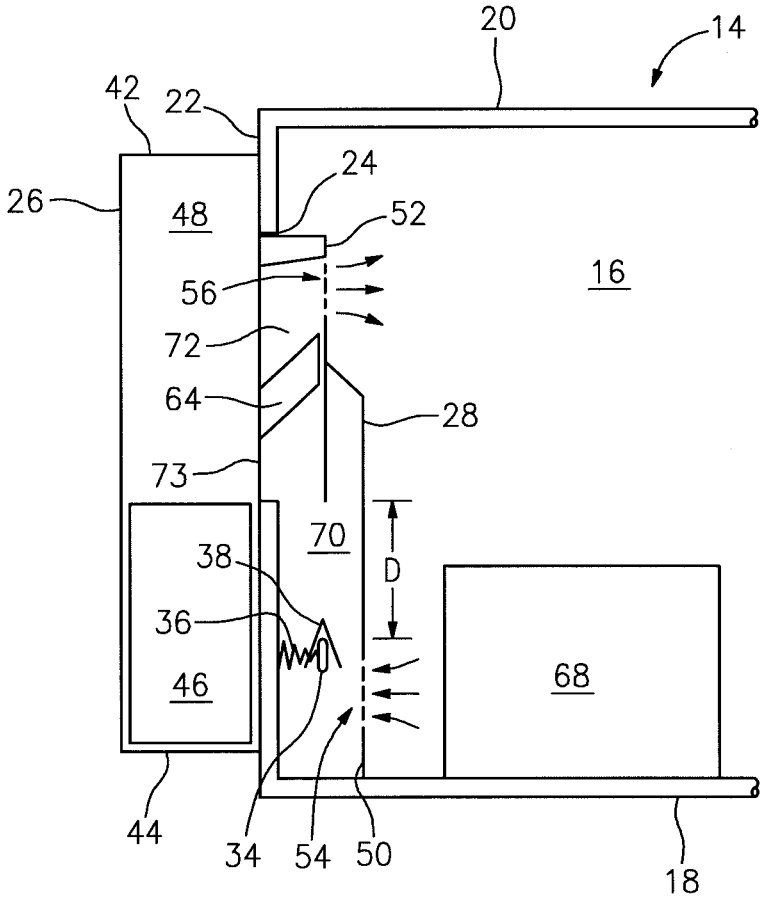
FIG. 2 is a diagrammatic illustration of one embodiment of the mobile refrigeration system in FIG. 1.

FIG. 1 is a diagrammatic illustration of a refrigerated transportation unit 10 ("transportation unit") in the form of a tractor trailer. Other types of refrigerated transportation units 10 include box trucks, buses, shipping containers, etc. The transportation unit 10 includes a mobile refrigeration system 12 ("refrigeration system") operable to regulate environmental conditions (e.g., air temperature) within an enclosure 14 that is typically insulated. Referring now to FIG. 2, the enclosure 14 has a plurality of structural panels which enclose an inner volume 16 (i.e., the portion of the transportation unit 10 that is to be environmentally maintained by the refrigeration system 12, hereinafter referred to as the "control region"). The structural panels include a floor 18, a roof 20, and a plurality of walls 22. In one embodiment, one of the structural panels (e.g., a front wall 22) has an aperture 24 sized to mate with a portion of the refrigeration system 12.

FIG. 2 is a diagrammatic illustration of one embodiment of the refrigeration system 12 in FIG. 1. The refrigeration system 12 includes a housing 26, a bulkhead 28, a power package 30, a refrigeration loop 32, at least one sensor 34, a shock absorption unit 36, an optional sensor cover 38, and a controller 40.

The housing 26 extends between two ends (e.g., a top end 42 and a bottom end 44) and includes an engine compartment 46 and a refrigeration component compartment 48. In the embodiment in FIG. 2, the engine compartment 46 is disposed at the bottom end 44 of the housing 26 and the refrigeration component compartment 48 is disposed at the top end 42 of the housing 26.

The bulkhead 28 extends between a first end 50 (e.g., a bottom end) and a second end 52 (e.g., a top end). The bulkhead 28 includes an air inlet 54 (e.g., a return air vent) and an air outlet 56 (e.g., a supply air vent). In the embodiment in FIG. 2, the return air vent 54 is disposed proximate to the bottom end 50 of the bulkhead 28 and the supply air vent 56 is disposed adjacent the top end 52 of the bulkhead 28.

The power package 30 is adapted to provide electrical and/or mechanical power (e.g., via electricity, belt driven pulleys, etc.) to one or more of the components of the refrigeration system 12 (e.g., a compressor, a fan, a sensor, a controller, etc.). Power packages are well known in the art, and the present invention is not limited to any particular configuration thereof. Types of power packages can include diesel or gas generators, alternators, batteries, or a combination thereof. One example of a power package is disclosed in U.S. Pat. No. 5,916,253 to Amr et al., which is hereby incorporated by reference in its entirety. To simplify the description of the present invention, the present detailed description describes the power package 30 as a generator; however, the present invention is not limited thereto.

Figure 3:
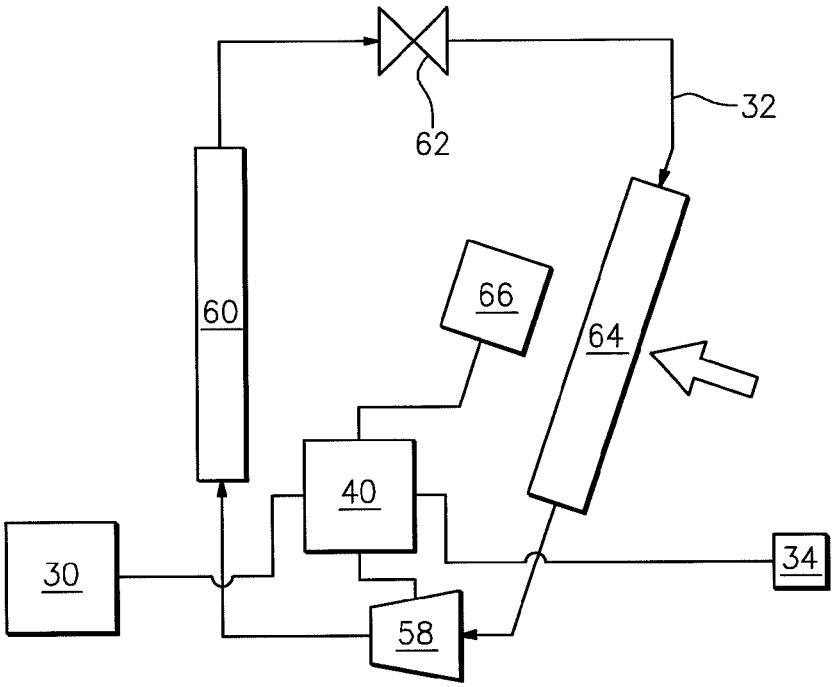
FIG. 3 is a diagrammatic illustration of one embodiment of a refrigeration loop.

FIG. 3 is a diagrammatic illustration of one embodiment of the refrigeration loop 32 shown in FIG. 2. The refrigeration loop 32 includes a compressor 58, a condenser 60, a refrigerant regulator 62, an evaporator 64 and at least one fan 66. The refrigeration loop 32 is configured such that liquid refrigerant is directed through the compressor 58, the condenser 60, the refrigerant regulator 62 (e.g., a thermal expansion valve), and the evaporator 64 in a closed loop path. The fan 66 is adapted to direct air from the control region 16, and/or from outside the control region 16, through the evaporator 64, and back into the control region 16. An example of a refrigeration loop is disclosed in U.S. Pat. No. 6,318,100 to Brendel et al., which is hereby incorporated by reference in its entirety.

Referring again to FIG. 2, the sensor 34 (e.g., a return air temperature "RAT" sensor) is adapted to measure at least one parameter (e.g., air temperature) indicative of the internal environmental conditions in the control region 16. The sensor 34 is further adapted to output a feedback signal indicative of the measured parameter (e.g., air temperature) to the controller 40. To simplify the description of the present invention, the present detailed description describes the sensor 34 as a RAT sensor. However, the present invention is not limited to any particular type of sensor.

The shock absorption unit 36 includes a spring element and is configured as a sensor mount. The shock absorption unit 36 is operable to (i) dampen dynamic shock loads (e.g., impact loads caused by shifting cargo 68 in the control region 16 during loading or transport), and (ii) reduce conduction of heat (e.g., generated from the power package 30 during operation) through the shock absorption unit 36 to the RAT sensor 34. In one embodiment, the spring element is a helical, metal wire spring having a cross-sectional area sized to reduce/limit thermal conduction through the spring element to the RAT sensor 34. For example, the spring element may reduce thermal conduction therethrough to the RAT sensor 34 where the spring element has a relatively small cross-sectional area as compared to the surface area of the RAT sensor 34. However, the present invention is not limited to such a helical spring configuration.

The sensor cover 38 is configured as a thermal barrier. In the embodiment illustrated in FIG. 2, the sensor cover 38 is a conical sheet metal cover sized to extend over the top of, and at least partially around the sides of the RAT sensor 34. In alternate embodiments, the sensor cover 38 can extend completely around the sides of the RAT sensor 34, or alternately solely cover the top of the RAT sensor 34. The sensor cover 38, however, is not limited to these exemplary configurations.

Referring to FIG. 3, the controller 40 includes a processor that is adapted to receive the temperature feedback signal from the RAT sensor 34. In addition, depending on the configuration of the refrigeration system 12, the processor can also receive additional feedback signals (e.g., indicative of pressure, humidity, etc.) from additional sensors (not shown). The processor is further adapted to selectively maintain or change the operating mode of the refrigeration system 12 using actuators (e.g., switches, valves, etc.; not shown) in communication with components of the refrigeration system 12 (e.g., the power package 30, the compressor 58, the fan 66) based on the feedback signal(s) (e.g., the temperature feedback signal), an algorithm, or some combination thereof. It should be noted that the functionality of the processor may be implemented using hardware, software, firmware, or a combination thereof. One example of a suitable controller is described in the U.S. Pat. No. 6,318,100 to Brendel et al.

In the embodiment shown in FIG. 2 the housing 26 and the bulkhead 28 are arranged on opposite sides of the front wall 22 of the transportation unit 10. In alternate embodiments, the housing 26 and the bulkhead 28 can be arranged on opposite sides of any structural member of the transportation unit 10 such as the roof 20, etc. The bulkhead 28 is positioned within the enclosure 14 such that a first air duct 70 (e.g., a return duct) is defined at least partially between the bulkhead 28 and the front wall 22 of the transportation unit 10. The return duct 70 extends between the return air vent 54 in the bulkhead 28 and the evaporator 64. A second air duct 72 (e.g., a supply duct) extends between the evaporator 64 and the supply air vent 56 in the bulkhead 28. In some embodiments, an airflow barrier such as an insulated panel 73 is disposed between the housing 26 and the bulkhead 28 such that substantially no air flows between (i) the return and/or the supply ducts 70, 72, and (ii) the engine and/or the refrigeration component compartments 46, 48.

The generator 30 is disposed in the engine compartment 46 of the housing 26. One or more of the components of the refrigeration loop 32 (e.g., the compressor 58, the condenser 60 and the refrigerant regulator 62) are disposed in the refrigeration component compartment 48 of the housing 26. The fan 66 is disposed in the supply duct 72. In an alternate embodiment, the fan 66 is disposed in the return duct 70.

The RAT sensor 34 is disposed in the return duct 70 and positioned at a distance D from the aperture 24 in the front wall 22. The distance D is selected to mitigate or prevent other components of the refrigeration system 12 (e.g., the generator 30) from adversely influencing the measurements of the sensor 34 (e.g., by heating or cooling air proximate the RAT sensor), which will be described below in further detail. For example, in the embodiment in FIG. 2, the RAT sensor 34 is positioned at a distance D below the aperture 24 in the front wall 22 such that (i) the RAT sensor 34 is proximate the return air vent 54, and (ii) the front wall 22 functions as a thermal barrier between the engine compartment 46 and the RAT sensor 34. Notably, the distance D will depend upon the configuration and thermal properties of the refrigeration system 12; e.g., heat output of the generator 30, insulation properties of the engine compartment 46, etc.

The shock absorption unit 36 mounts the RAT sensor 34 to the front wall 22 such that the RAT sensor 34 is approximately centered between the bulkhead 28 and the front wall 22 (i.e., in the middle of the return duct 70). In an alternate embodiment, the shock absorption unit 36 mounts the RAT sensor 34 to the bulkhead 28. The optional sensor cover 38 is disposed between the RAT sensor 34 and the evaporator 64. For example, as illustrated in FIG. 2, the sensor cover 38 is arranged above the top of and around the sides of the RAT sensor 34.

During loading or transit, cargo 68 (e.g., containers of perishable goods, etc.) can drop/fall on the floor 18 and/or slam (i.e., be thrust) against the bulkhead 28 inducing a dynamic shock load/shock wave within the transportation unit 10. The spring member of the shock absorption unit 36 can at least partially absorb/dampen this induced shock wave (depending on its magnitude), reducing or preventing damage to the RAT sensor 34. For example, where cargo 68 is slammed against the bulkhead 28, a shock wave can propagate from the bulkhead 28, through the floor 18 and the front wall 22, into the shock absorption unit 36. In this example, the spring member of the shock absorption unit 36 dissipates the induced shock wave, thus damping the shock load on the RAT sensor 34. By damping the shock load, internal stresses and strains are reduced protecting the internal circuitry of the RAT sensor 34 from breaking, cracking, etc., which can increase the useful life thereof.

During operation of the refrigeration system 12, the controller 40 engages (e.g., turns on), disengages (e.g., turns off) and/or regulates (e.g., increase/decreases the operational speed or output of) one or more of the components of the refrigeration system 12 (e.g., the compressor 58, the fan 66, the generator 30) in order to regulate environmental conditions in the control region 16. For example, in one embodiment, the controller 40 operates the refrigeration system 12 according to on/off cycles. In this example, the RAT sensor 34 measures the temperature of the air (e.g., proximate to the return air vent 54) in the return duct 70 and provides a feedback signal indicative of the measured temperature to the controller 40. Notably, this measured temperature should directly correlate to the air temperature within the control region 16. For example, when the temperature in the control region 16 increases, the temperature proximate the RAT sensor 34 should increase a proportional amount. Alternatively, when temperature in the control region 16 decreases, the temperature proximate the RAT sensor 34 should decrease a proportional amount.

The controller 40 is adapted to receive the feedback signal from the RAT sensor 34 and determine whether the refrigeration system 12 should operate in the on-cycle or the off-cycle. To make that determination, for example, the controller 40 can be adapted to compare the feedback signal to a predetermined value (e.g., a particular temperature or temperature range). When the feedback signal is greater than or equal to the predetermined value, the refrigeration system 12 operates in the on-cycle. When the feedback signal is less than the predetermined value, the refrigeration system 12 operates in the off-cycle.

Figure 4:
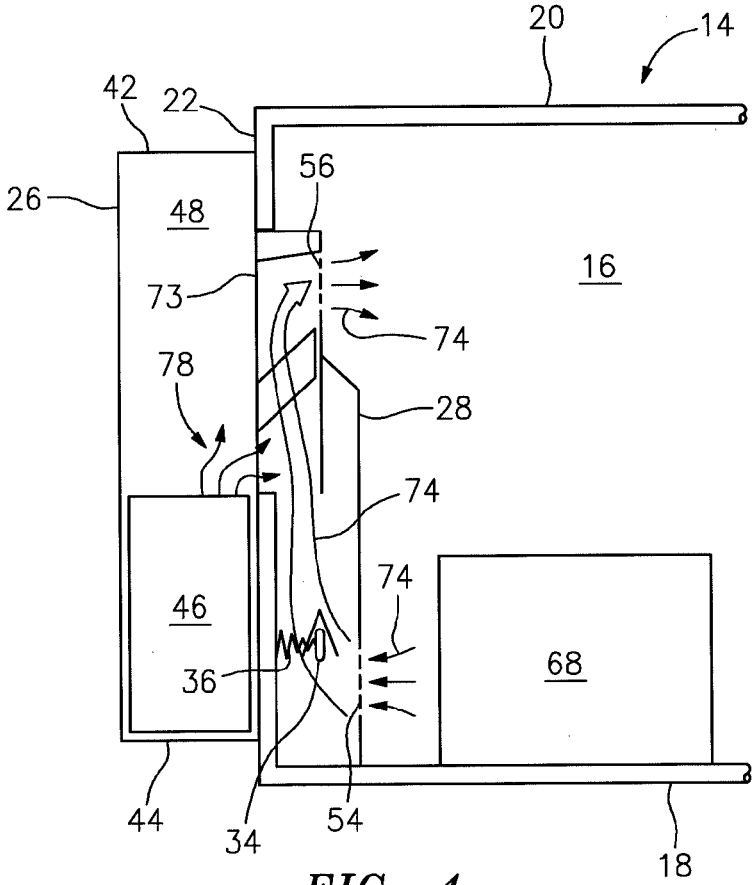
FIG. 4 is an air and heat flow diagram of the mobile refrigeration system in FIG. 2 during an "on-cycle".

Referring now to FIG. 4, in the on-cycle, airflow 74 is drawn from the control region 16, through the return air vent 54, into the return duct 70. The return duct 70 directs the airflow 74 to the evaporator 64, which transfers heat out of (i.e., cools) the airflow 74. From the evaporator 64, the fan 66 directs the cooled airflow 74, through the supply duct 72 and the supply air vent 56, into the control region 16, where the airflow 74 cools the cargo 68.

Figure 5:
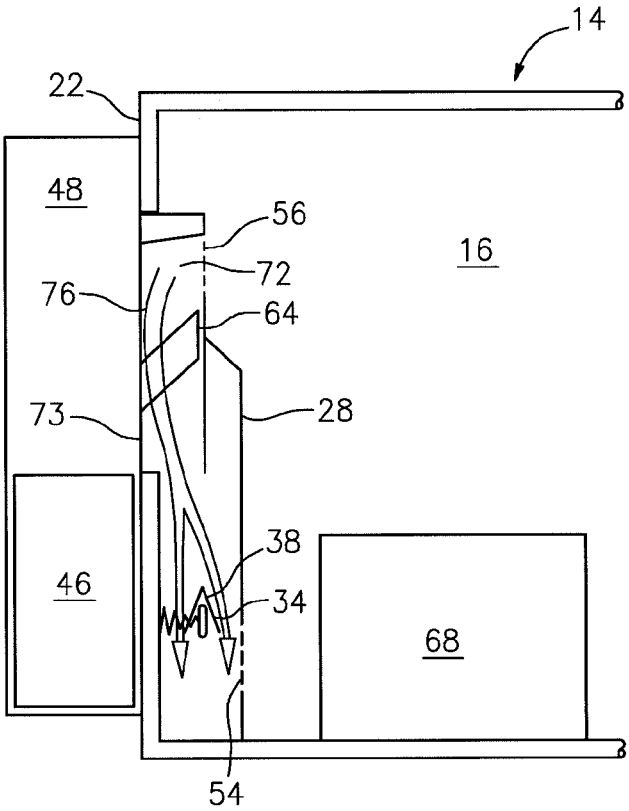
FIG. 5 is an air flow diagram of the mobile refrigeration system in FIG. 2 during an "off-cycle".

Referring now to FIG. 5, in the off-cycle, after the refrigeration loop 32 is disengaged (e.g., turned off), a quantity of the relatively cool air 76 between the evaporator 64 and the supply air vent 56 can fall/sink towards the return air vent 54 (since this relatively cool air 76 is denser than the relatively warmer air between the evaporator 64 and the return air vent 54). The sensor cover 38 directs at least a portion of this falling cooler air 76 (i.e., a backflow) around and away from the RAT sensor 34. Thus, depending on the quantity of the cooler air 76 which falls, the air temperature proximate the RAT sensor 34 may be unaffected (e.g., be cooled) by the falling cooler air 76.

In both the on-cycle and the off-cycle, heat can radiate from the generator 30 and the engine compartment 46 into the surrounding environment. For example, in the on-cycle, the generator 30 can provide power to one or more of the components of the refrigeration loop 32 (e.g., the fan 66, the compressor 58, etc.). As a by-product of providing power, the generator 30 produces and radiates thermal energy 78. In addition, the generator 30 and the engine compartment 46 can accumulate a thermal energy buildup after a period sustained operation. Thus, even during the off-cycle when the generator 30 is non-operational, the thermal energy buildup can radiate therefrom until sufficient time has passed where the generator 30 and/or the engine compartment 46 has cooled to ambient temperature.

Figure 6:
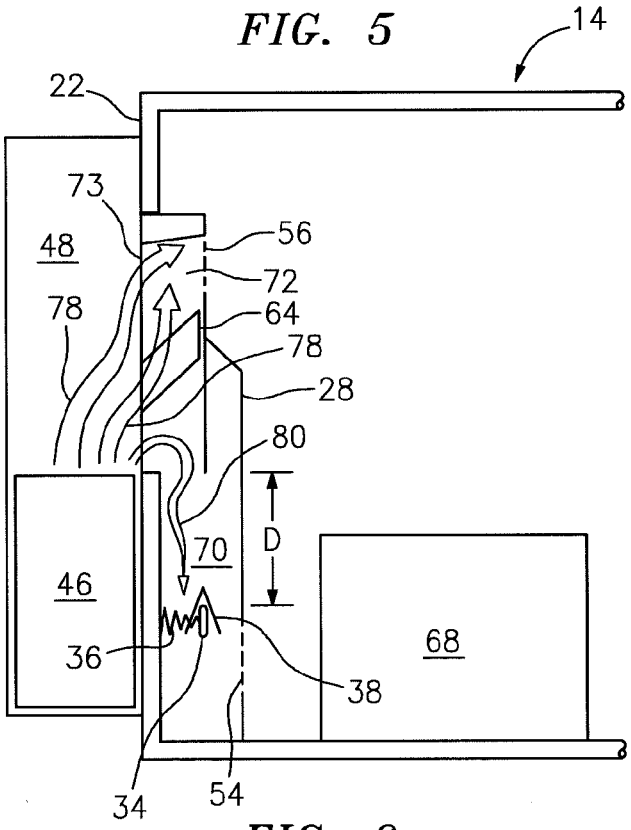
FIG. 6 is a heat flow diagram of the mobile refrigeration system in FIG. 2 during the "off-cycle".

Referring to FIGS. 4 and 6, the thermal energy 78 from the generator 30 and the engine compartment 46 can radiate through the insulated panel 73 and the aperture 24 in the front wall 22 into the return duct 70. A portion of the thermal energy 78 (not shown) can also radiate through walls of the housing 26 out of the refrigeration system 12. Referring to FIG. 4, during the on-cycle, substantially all the radiated thermal energy 78 is transferred into the airflow 74 travelling from the return air vent 54 to the supply air vent 56. Thus, this radiated thermal energy 78 is directed (e.g., via convection) away from the RAT sensor 34. Referring to FIG. 6, during the off-cycle, a relatively large portion of the thermal energy 78 can radiate toward the supply air vent 56, and a relatively small portion of the thermal energy 80 can radiate toward the return air vent 54. The portion of the thermal energy 80 that radiates towards the return air vent 54 substantially or completely dissipates before it traverses the distance D between the aperture 24 in the front wall 22 and the RAT sensor 34. In addition, the insulated front wall 22 reduces or eliminates conductive heat transfer between the engine compartment 46 and the return duct 70. As a result, the RAT sensor 34 is only insignificantly, or not at all, influenced by the thermal energy 78, 80 developed by the generator 30 and/or engine compartment 46. The shock absorption unit 36 may further reduce conductive heat transfer between the front wall 22 and the RAT sensor 34, thereby further reducing distortive effects from the thermal energy 78, 80 on the RAT sensor 34. For example, where the shock absorption unit 36 includes a helical wire spring, the relatively small cross-sectional area of the wire does not permit a significant quantity of heat to transfer therethrough to the RAT sensor 34.

The air surrounding the RAT sensor 34 is substantially unaffected by the components of (e.g., the generator 30, etc.) and/or the environment in (e.g., radiating thermal energy, relatively cool falling air, etc.) the refrigeration system 12 during operation. Accordingly, the environmental conditions surrounding the RAT sensor 34 accurately represent the environmental conditions in the control region 16. For example, when the air temperature in the control region 16 increases, the air temperature proximate the RAT sensor 34 increases a proportional amount. When the air temperature in the control region 16 decreases, the air temperature proximate the RAT sensor 34 decreases a proportional amount. The accuracy of the sensor helps to increase the energy efficiency of the refrigeration system 12 (e.g., on/off cycling due to inaccurate temperature measurements is reduced or eliminated) and the temperature in the control region 16 is more accurately maintained, thereby minimizing the potential for under-cooling or over-cooling.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A refrigeration system for a mobile unit, comprising:

a refrigeration loop including a compressor, a condenser, a refrigerant regulator and an evaporator;

a longitudinally extending air duct that directs air from an air inlet to the evaporator, which air duct is defined by first and second panels;

a sensor disposed in the air duct; and a shock absorption unit that mounts the sensor to and provides a limited thermal conduction path between the sensor and the first panel, wherein the shock absorption unit is exposed to flow of the air through the air duct, and wherein the shock absorption unit comprises a spring element which laterally anchors the sensor to the first panel;

wherein the spring element comprises a plurality of coils, and the coils are entirely disposed between the first panel and the sensor so as to measure air temperature during normal operation of the spring element.

2. The refrigeration system of claim 1, wherein the sensor comprises a return air temperature sensor.

3. The refrigeration system of claim 1, wherein the sensor is disposed proximate the air inlet of the air duct.

4. The refrigeration system of claim 1, wherein the shock absorption unit has a relatively small cross sectional area as compared to a surface area of the sensor.

5. The refrigeration system of claim 1, further comprising a sensor cover for directing a backflow around the sensor.

6. The refrigeration system of claim 5, wherein the sensor cover extends over a top of, and at least partially around sides of the sensor.

7. The refrigeration system of claim 1, further comprising a power package that powers the refrigeration loop, wherein the first panel of the air duct is disposed between the sensor and the power package.

8. The refrigeration system of claim 7, wherein the first panel is an insulated wall and the second panel is a bulkhead.

9. The refrigeration system of claim 1, wherein the spring element comprises a metal spring element.

10. The refrigeration system of claim 1, wherein the coils are wrapped about a centerline, and the spring element extends laterally and along the centerline from the first panel to the sensor.

11. A method for regulating environmental conditions in a control region of a mobile unit, comprising:

providing a mobile refrigeration system including a power package and a sensor disposed in a longitudinally extending return air duct and laterally centered within the return air duct;

thermally isolating the sensor from thermal energy radiated and conducted from the power package using a spring element that mounts the sensor to the return air duct, wherein the spring element comprises a plurality of coils, and the coils are entirely disposed between a panel of the return air duct and the sensor so as to measure air temperature during normal operation of the spring element;

measuring with the sensor at least one parameter indicative of the environmental conditions in the control region of the mobile unit, wherein the at least one parameter comprises the air temperature; and regulating the environmental conditions in the mobile unit based on the measured parameter.

12. The method of claim 11, wherein the step of thermally isolating comprises reducing thermal conduction between the return air duct and the sensor.

13. The method of claim 11, wherein the return air duct extends between an air inlet and an evaporator, and further comprising providing a supply air duct extending between the evaporator and an air outlet.

14. The method of claim 13, wherein the at least one parameter is measured proximate the air inlet.

15. The method of claim 13, further comprising at least partially isolating the sensor from a dynamic shock load.

16. The method of claim 13, wherein the step of regulating environmental conditions includes:

directing an airflow from the control region, through the air inlet and the first duct, to the evaporator;

transferring thermal energy from the airflow into the evaporator; and directing the airflow from the evaporator, through a second duct and the air outlet, to the control region.

17. A method for regulating environmental conditions in a control region of a mobile unit, comprising:

providing a mobile refrigeration system including a longitudinally extending first duct extending between an air inlet and an evaporator, a second duct extending between the evaporator and an air outlet, and a sensor;

damping a dynamic shock load transferred to the sensor using a shock absorption unit exposed to flow of air through the first duct, wherein the shock absorption unit laterally connects and is between and thereby laterally separates the sensor and a wall of the first duct, wherein the shock absorption unit comprises a spring element which attaches the sensor to the wall, wherein the spring element comprises a plurality of coils, and wherein the coils are entirely disposed between the wall and the sensor so as to measure air temperature during normal operation of the spring element;

measuring with the sensor at least one parameter indicative of the environmental conditions in the control region of the mobile unit, wherein the at least one parameter comprises the air temperature; and regulating the environmental conditions in the mobile unit based on the measured parameter.

18. The method of claim 17, further comprising thermally isolating the sensor from thermal energy radiated and conducted from a power package.

19. The method of claim 18, wherein the step of thermally isolating comprises reducing thermal conduction to the sensor via the spring element a sensor mount.

20. The method of claim 18, wherein the at least one parameter is measured proximate the air inlet.

21. The method of claim 17, wherein the step of regulating environmental conditions includes:

directing an airflow from the control region, through the air inlet and the first duct, to the evaporator;

transferring thermal energy from the airflow into the evaporator; and directing the airflow from the evaporator, through the second duct and the air outlet, to the control region.

22. The method of claim 13, wherein the sensor is laterally mounted and anchored to a wall of the first duct by a metal spring element, and the spring element comprises the metal spring element.

23. A refrigeration system for a mobile unit, comprising:

a refrigeration loop including a compressor, a condenser, a refrigerant regulator and an evaporator;

an air duct that directs air from an air inlet to the evaporator, which air duct is defined by first and second panels;

a sensor disposed in the air duct; and a shock absorption unit that provides a limited thermal conduction path between the sensor and the first panel, wherein the shock absorption unit is exposed to flow of the air through the air duct;

wherein the sensor is mounted to the first panel solely by the shock absorption unit;

wherein the shock absorption unit comprises a spring element mounting the sensor to the first panel;

wherein the spring element comprises a plurality of coils; and wherein the coils are entirely disposed between the first panel and the sensor so as to measure air temperature during normal operation of the spring element.

* * * * *